United States Patent [19]

Ono

[11] 4,056,860

[45] Nov. 8, 1977

[54] METHOD OF DYEING WOUND UP YARN

[75] Inventor: Nobutaka Ono, Ashiya, Japan

[73] Assignee: Osaka Bobbin Kabushiki Kaisha, Japan

[21] Appl. No.: 651,333

[22] Filed: Jan. 22, 1976

[30] Foreign Application Priority Data

Oct. 13, 1975 Japan ..... 50-123708

[51] Int. Cl.[2] ..... D06B 5/18

[52] U.S. Cl. ..... 8/155.1

[58] Field of Search ..... 8/154, 155.1, 155.2; 242/18 A, 35.5 R, 118.11, 118.1; 57/164; 28/58 B, 72 SP; 68/13 R, 198

[56] References Cited

U.S. PATENT DOCUMENTS

| | | | |
|---|---|---|---|
| 2,980,354 | 4/1961 | Mason | 242/118.1 |
| 3,563,490 | 2/1971 | Berger | 57/164 X |
| 3,563,491 | 2/1971 | Hahm et al. | 242/118.11 |
| 3,936,009 | 2/1976 | Livingstone | 242/118.11 |
| 3,948,452 | 4/1976 | Burysek et al. | 242/18 A |

*Primary Examiner*—Philip R. Coe

*Attorney, Agent, or Firm*—Robert E. Burns; Emmanuel J. Lobato; Bruce L. Adams

[57] ABSTRACT

Yarns spun by a fine spinning frame are rewound from the spun cops directly into cheeses on compressible bobbins which are contractable in the axial and radial directions. The bobbins with cheese thus wound up are piled one upon another on spindles of a carrier without interposing any spacer therebetween and compressed in the axial direction so that both ends of every bobbin come in the same planes with both ends of respective cheese. By dyeing the cheeses in this condition by a usual cheese dyeing method, a uniform dyeing without any dyeing unevenness can be effected in a greatly simplified process.

3 Claims, 3 Drawing Figures

METHOD OF DYEING WOUND UP YARN

BACKGROUND OF THE INVENTION

This invention relates to a method of dyeing effectively and uniformly yarns spun by fine spinning frames.

Heretofore, for dyeing or heat treatment of yarns spun by fine spinning frames, such as ring and mule spinning frames, the yarns are commonly rewound on bobbins for purposes of the dyeing process after once being wound up in the form of cone from the spun cops. It is usually necessary for the winding-up of a cone to combine a plurality of cops, since the amount of wound-up yarn in a cop is smaller than that in the cone.

In the rewinding of cop yarn, there may arise, depending upon the shape of the cop, a difference in the rewinding tension between the yarns in the outer and in the inner layers of a cop. As a result, if the cop yarns are to be directly rewound on dyeing bobbins, the cheeses will be formed with so-called "annual rings" on account of the alternately repeated high and low rewinding tensions and will lead to dyeing variation of the yarn. But, if the cop yarn is to be rewound at a regulated, constant tension in order to prevent the formation of the annual rings, it must be rewound at a tension in agreement with the maximum tension of the cop yarn. Such a high rewinding tension, however, leads to a high winding density, which will cause various troubles in the dyeing process.

It is widely known that soft winding is suitable for wound-up yarn to be dyed smoothly and advantageously, and dyeing and treatments under low winding densities by soft winding are studied and practiced in various areas. On the other hand, direct rewinding from spun cops, being impossible to effect soft winding as mentioned above, will lead to various difficulties in dyeing.

Therefore, it has been necessary to wind up the yarns once from cops to cones and then rewind them soft on bobbins for the dyeing process in consideration of wind-up density.

SUMMARY OF THE INVENTION

It is an object of the present invention to provide a method for effecting uniform dyeing of yarns from fine spinning frames without any dyeing difference between inner and outer layers of a cop.

Another object of the invention is to provide a novel method of dyeing wherein the cone-winding step required in the conventional processes can be eliminated and the process can be largely simplified in dyeing yarns spun by fine spinning frames.

Still another object of the invention is to provide a great increase in dyeing capacity and dyeing productivity as well as a reduction in spacer cost, by enabling the dyeing with the bobbins piled atop one another without using spacer.

The dyeing method according to the present invention for attaining the above objects is characterized in that yarns spun by a fine spinning frame are wound up from the cops directly into cheeses on compressible bobbins which are contractable both in the axial and in the radial directions, under a tension equal to the maximum tension during the cop winding, and said compressible bobbins are, after being piled one upon another on the spindles of a carrier for hanging cheeses without any interposed spacer therebetween, compressed in the axial direction so that the bobbins and cheeses thereon contract in axial and radial directions until both upper and lower ends of the bobbins come in the same planes with both ends of respective cheeses, thus giving tension relaxation to the yarns on account of the slackening in the direction of winding traverse and contraction in the radial direction of the bobbins. Then, the cheese yarns are dyed by means of a usual cheese dyeing machine.

Other features and advantages of the invention will be apparent from the following description taken in connection with the accompanying drawings. It is to be expressly understood, however, that the description and the drawings are for purpose of explanation only and are not intended as a definition of the limits of the invention.

DETAILED DESCRIPTION OF THE INVENTION

Figure 1:
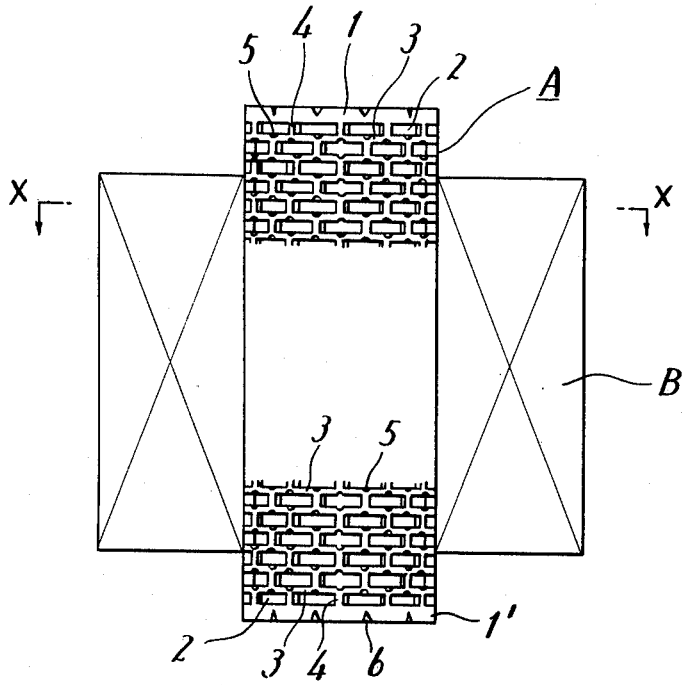
FIG. 1 is a schematic elevation showing an embodiment of bobbin winding according to the dyeing method of the invention.
Figure 2:
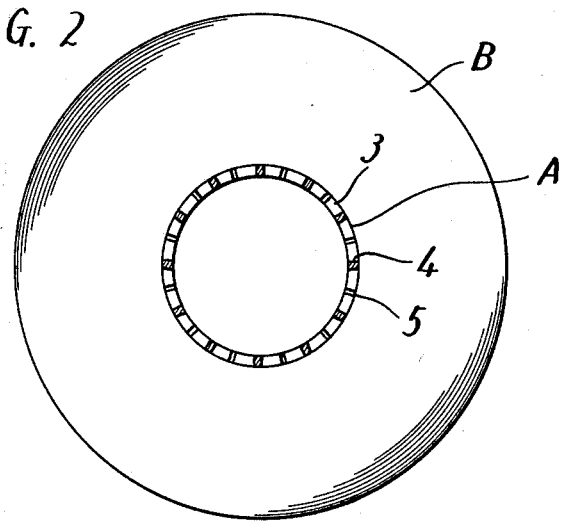
FIG. 2 is a section view on line X — X in FIG. 1.

In the drawings, A indicates an example of compressible bobbin, used in the method of the invention, made of a thermoplastic synthetic resin such as polypropylene by a known molding process. The compressible bobbin A is provided around its surface with a large number of laterally long rectangular holes 2 arranged closely in a plurality of closely arranged circumferential rows and in an alternate relation to each other with respect to the axial direction of the bobbin. The bobbin A, although formed in a cylindrical shape in FIG. 1, may have a frusto-conical shape, and in this case it is preferable to form the holes 2 in a trapezoidal shape. The adjacent long sides of the corresponding rectangular holes 2 in adjacent circumferential rows define therebetween lateral ring frames 3 in union throughout the circumference. Adjacent short sides 4 of adjacent rectangular holes 2 in a row form therebetween longitudinal frames in a manner that each of the longitudinal frames connects respective adjacent lateral ring frames 3 at the middle position between the longitudinal frames in upper and lower rows adjacent to the lateral ring frames 3. Both ends 1, 1' of the bobbin, which form annular portions, are provided with notches 6 on their outer sides at the middle positions of all laterally long holes 2 of the adjacent row so that the widths of the annular end portions are smaller at the positions than at other portions and, if necessary, than the width of the lateral ring frames 3 to some extent. However, since the contraction in the radial direction is smaller in comparison with the axial compression, the end portions 1, 1' may be formed in the same width throughout the circumference. The bobbin shown in the figures has also notched dents 5 on the sides of the lateral ring frames facing the holes 2 at all positions where longitudinal short frames are connected in the adjacent rows, in order to facilitate the zigzag bending of the lateral ring frames 3.

The depth and the size of the notched dents 5 and the notches 6 of said annular portions 1, 1' must be determined in accordance with the degree of compression intended. It should be noted that too large sizes of them may lead to weakness in the lateral rings 3 and annular portions 1, 1'. The shape of the notched dents and notches are not limited to those shown in the figure. The symbol B indicates the layers of wound yarn (cheese).

The dyeing process of the present invention by the use of said compressible bobbins is hereinafter illustrated.

Yarns which have been spun by a ring or mule spinning machine are first wound up from the cops directly on said compressible bobbins A with traverse motion by a known winding means to form yarn layers B to be dyed. In this case, of course, yarns from a plurality of cops are pieced one after another on a bobbin according to the difference between the amounts on a cop and a bobbin. In the re-winding of yarn, as a difference or fluctuation in yarn tension may arise between the outer layer and inner or deeper layer on the cop, on account of its shape, it must be carried out under a yarn tension controlled to the maximum of the above tension so as to prevent yarn tension variation.

Figure 3:
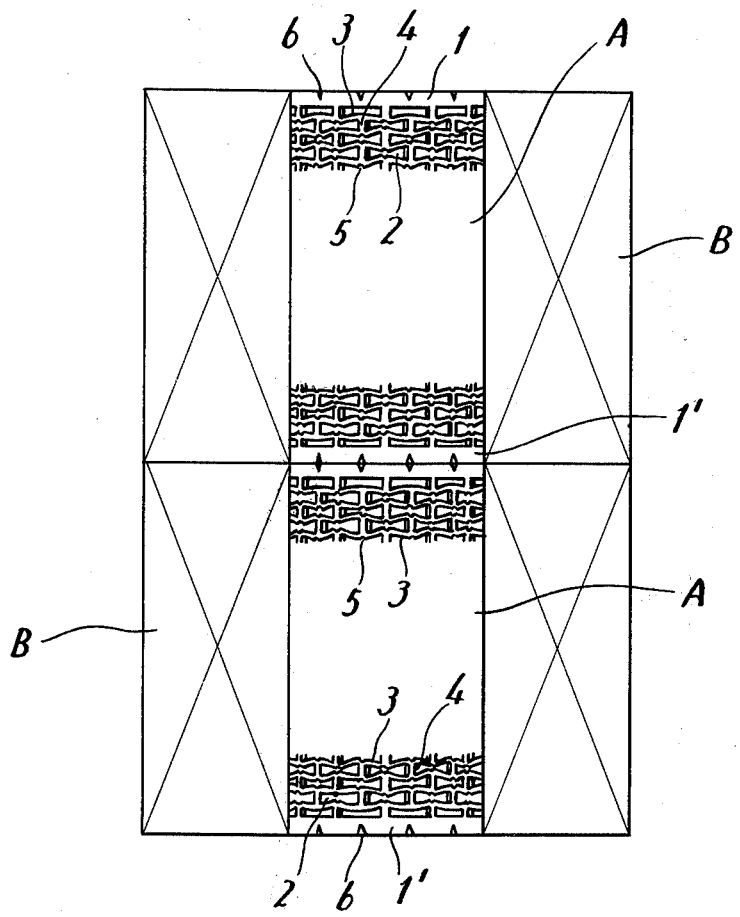
FIG. 3 is a schematic view showing an aspect of the bobbins piled up and compressed.

The compressible bobbins A with cheeses B thus wound up from the cops are then piled up one upon another on the spindles of a carrier according to the usual cheese dyeing method, in which no spacer is necessary to be interposed between the bobbins according to the invention. The piles of the bobbins thus formed are compressed in the axial direction of the bobbins with pads for compression fitted to both ends of the pile. As the body of bobbin A is made of a thermoplastic synthetic resin and notched dents 5 are provided at the junctions of the longitudinal frames 4 and the lateral ring frames 3, the lateral ring frames are bent, pushed by the longitudinal frames 4, in a zigzag form as shown in FIG. 3, and the bobbin is decreased in its radius as well as in its axial length. The yarn layers B wound on the bobbins A are also compressed in the axial direction with their traverse angle flattened so that they become as soft as would be effected substantially by soft winding, on account of the flattened traverse and slackened tension by the release given by the radial contraction of the bobbin.

It is preferable to bring both ends of the bobbins in the same planes with both ends of the cheeses by the compression.

The yarns wound-up on compressible bobbins and thus compressed are then dyed in a known manner. As the bobbins are, as described above, piled one upon another on the spindles of the carrier and compressed without the use of spacers, which are usually applied in the conventional dyeing, a plurality of cheeses are integrated into a single mass or body mass and permit the dyeing without leakage of the dyeing solution. The dyeing process is performed by means of a known dyeing apparatus and the dyeing solution passes through the long rectangular holes 2 and the yarn layers to effect the dyeing. During the dyeing, the contraction of the yarns will hardly affect the properties of the yarns because the bobbins have been contracted in advance.

The bobbin to be used in the method of the invention is not limited to that shown in the figures, as explained in the above description, but any other compressible bobbin having similar performance can be used, and may be also useful in other processes than dyeing, such as heat treatment of yarn.

As is obvious from the above description, the method of the present invention has the following advantages:

1. As the yarns spun by a fine spinning frame are wound up from the cops directly on the compressible bobbins for the dyeing process, it permits the elimination of one step from the conventional dyeing process, in which the yarns are once wound up to cones before they are rewound on the dyeing bobbins, thus contributing to the simplification of the dyeing process.

2. Since the compressible bobbin used in the method permits a sufficient release of tension of the yarn wound up thereon under a high tension from the cops, owing to its contraction in the axial and radial directions by compression thereafter, the present method makes it possible to attain a uniform dyeing without any dyeing variation, and prevent the influence of tension variation such as "annual rings" due to the rewinding of cops, by rewinding the yarn on the compressible bobbins under a maximum, uniform tension and then releasing the tension by compressing the piled bobbins.

3. The relaxation due to the flattened traverse angle and release due to the contraction in the radial direction of the bobbin by compression after winding up, give the wound-up yarns softness, which is required for good dyeing as in the case of soft winding, and permit a smooth flow of dyeing solution through the yarn layer, thus effecting even dyeing of the cheeses.

4. As the bobbins are piled up without the use of spacers and compressed until both ends of the bobbins come in the same planes with both ends of the yarn layers, the cheeses are integrated into a single mass or body, so that the dyeing solution can pass evenly through the yarn layers without any leakage and without causing fluff by channeling. Therefore, an excellent dyeing quality can be obtained as well as an improved efficiency because of increased dyeing capacity and reduction in costs by the elimination of the use of spacer.

I claim:

1. A method of dyeing wound-up yarns spun by a fine spinning frame and wound into cops, comprising the steps of:

a. winding up yarns from the cops directly into cheeses on compressible bobbins which are contractable in the axial and radial directions when compressed axially and carrying out the winding under a yarn tension substantially equal to the maximum of the fluctuating yarn tensions which occur during unwinding from the cops, b. piling at least two bobbins having cheese wound thereon one atop another in end-to-end relationship on a spindle of a carrier to form a bobbin pile, c. axially compressing the bobbins so as to effect axial and radial contraction of the bobbins to an extent sufficient to uniformly relax the yarns due to slackening of the yarns in the direction of winding traverse on the bobbins and due to contraction of the bobbins in the radial direction, and d. dyeing the cheeses while the bobbins are maintained in the compressed state with the yarns uniformly relaxed.

2. A method of dyeing wound-up yarns as claimed in claim 1, wherein said piling of the compressible bobbins on the spindles is carried out without interposing spacers between adjacent bobbins.

3. A method according to claim 1; wherein said step of compressing of the bobbin pile comprises compressing the bobbin pile such that each compressible bobbin is axially compressed until both bobbin ends are substantially flush with respective ends of the cheese wound thereon.

* * * * *